US009415898B2

(12) United States Patent
Nolan

(10) Patent No.: US 9,415,898 B2
(45) Date of Patent: Aug. 16, 2016

(54) BULK CONTAINER WITH ANGLED SIDE WALL TO BASE INSTALLATION

(71) Applicant: Orbis Corporation, Oconomowoc, WI (US)

(72) Inventor: Roger Nolan, Seymour, IN (US)

(73) Assignee: ORBIS Corporation, Oconomowoc, WI (US)

( * ) Notice: Subject to any disclaimer, the term of this patent is extended or adjusted under 35 U.S.C. 154(b) by 34 days.

(21) Appl. No.: 13/970,038

(22) Filed: Aug. 19, 2013

(65) Prior Publication Data

US 2014/0042175 A1 Feb. 13, 2014

Related U.S. Application Data

(63) Continuation of application No. 12/963,751, filed on Dec. 9, 2010, now Pat. No. 8,727,158.

(30) Foreign Application Priority Data

| | | |
|---|---|---|
| Dec. 16, 2009 | (CN) | 2009 3 0355382 |
| Dec. 16, 2009 | (CN) | 2009 3 0355383 |
| Dec. 16, 2009 | (CN) | 2009 3 0355384 |
| Feb. 10, 2010 | (CN) | 2010 2 0111642 |
| Mar. 16, 2010 | (CN) | 2010 2 0132357 |
| Mar. 30, 2010 | (CN) | 2010 2 0145498 |
| Apr. 14, 2010 | (CN) | 2010 2 0159206 |
| Apr. 23, 2010 | (CN) | 2010 2 0169698 |
| May 19, 2010 | (CN) | 2010 2 0198781 |
| Jun. 4, 2010 | (CN) | 2010 2 0218082 |
| Jun. 4, 2010 | (CN) | 2010 2 0218085 |

(51) Int. Cl.
*B65D 6/00* (2006.01)
*B65D 21/06* (2006.01)

(Continued)

(52) U.S. Cl.
CPC ..... *B65D 21/068* (2013.01); *B65D 19/18* (2013.01); *B65D 88/522* (2013.01); *B65D 2519/009* (2013.01); *B65D 2519/00034* (2013.01); *B65D 2519/00069* (2013.01); *B65D 2519/0096* (2013.01); *B65D 2519/00174* (2013.01); *B65D 2519/00268* (2013.01); *B65D 2519/00288* (2013.01); *B65D 2519/00318* (2013.01);

(Continued)

(58) Field of Classification Search
CPC ..... B65D 7/26; B65D 11/1833
USPC ..... 220/6, 7, 666, 4.28, 4.29, 4.31
See application file for complete search history.

(56) References Cited

U.S. PATENT DOCUMENTS

| | | | |
|---|---|---|---|
| 489,711 | A | 1/1893 | Mandioni |
| 1,039,452 | A | 9/1912 | Shepard |

(Continued)

FOREIGN PATENT DOCUMENTS

| | | | |
|---|---|---|---|
| CA | 2665281 | A1 | 11/2009 |
| CN | 200930355382 | | 7/2010 |

(Continued)

*Primary Examiner* — Jeffrey Allen
(74) *Attorney, Agent, or Firm* — Nixon Peabody LLP

(57) ABSTRACT

A collapsible bin container having a base portion and side walls hingedly connected to the base portion. At least one of the side walls includes an integrally formed hinge lug having a first generally cylindrical portion and a second flat angled portion. The base portion includes a corresponding hinge slot having an opening configured to receive the hinge lug only when the side wall is positioned at a first angle with respect to a horizontal surface.

20 Claims, 11 Drawing Sheets

(51) Int. Cl.
*B65D 19/18* (2006.01)
*B65D 88/52* (2006.01)

(52) U.S. Cl.
CPC ..... *B65D2519/00338* (2013.01); *B65D 2519/00402* (2013.01); *B65D 2519/00407* (2013.01); *B65D 2519/00422* (2013.01); *B65D 2519/00497* (2013.01); *B65D 2519/00502* (2013.01); *B65D 2519/00522* (2013.01); *B65D 2519/00587* (2013.01); *B65D 2519/00646* (2013.01); *B65D 2519/00805* (2013.01); *B65D 2519/00975* (2013.01)

(56) References Cited

U.S. PATENT DOCUMENTS

| | | | |
|---|---|---|---|
| 1,280,629 | A | 10/1918 | Appleby |
| 1,381,013 | A | 6/1921 | Rainsford |
| 2,579,655 | A | 12/1951 | Donald |
| 3,572,535 | A | 3/1971 | Kinzie |
| 3,628,683 | A | 12/1971 | Friedrich et al. |
| 3,747,794 | A | 7/1973 | Bitney |
| 3,870,185 | A | 3/1975 | Sanders et al. |
| 3,874,546 | A | 4/1975 | Sanders et al. |
| 3,924,293 | A | 12/1975 | Cain |
| 3,977,044 | A | 8/1976 | Mort |
| 4,044,910 | A | 8/1977 | Box |
| 4,063,330 | A | 12/1977 | Triplette |
| 4,119,263 | A | 10/1978 | Cuthbertson et al. |
| 4,186,841 | A | 2/1980 | Buckley et al. |
| 4,192,430 | A | 3/1980 | Cornou |
| 4,300,695 | A | 11/1981 | Hsu |
| 4,454,946 | A | 6/1984 | Yokowo |
| D277,042 | S | 1/1985 | Carter |
| 4,491,231 | A | 1/1985 | Heggeland et al. |
| 4,591,065 | A | 5/1986 | Foy |
| 4,674,647 | A | 6/1987 | Gyenge et al. |
| 4,765,480 | A | 8/1988 | Malmanger |
| 4,775,068 | A | 10/1988 | Reiland et al. |
| 4,798,304 | A | 1/1989 | Rader |
| 4,917,255 | A | 4/1990 | Foy et al. |
| 4,923,079 | A | 5/1990 | Foy |
| 4,967,927 | A | 11/1990 | Reiland et al. |
| 4,987,639 | A | 1/1991 | Baiuley et al. |
| 5,094,356 | A | 3/1992 | Miller |
| 5,114,037 | A | 5/1992 | Hillis et al. |
| 5,150,806 | A | 9/1992 | Glomski |
| 5,199,592 | A | 4/1993 | Reiland et al. |
| 5,289,935 | A | 3/1994 | Hillis et al. |
| 5,398,835 | A | 3/1995 | Blinstrub |
| 5,467,885 | A | 11/1995 | Blinstrub |
| 5,474,197 | A | 12/1995 | Hillis et al. |
| 5,501,353 | A | 3/1996 | Warren |
| 5,538,178 | A | 7/1996 | Zink et al. |
| 5,586,675 | A | 12/1996 | Borsboom et al. |
| 5,632,392 | A | 5/1997 | Oh |
| D381,513 | S | 7/1997 | Brauner |
| 5,660,291 | A | 8/1997 | Dash |
| 5,673,791 | A | 10/1997 | Jamison |
| 5,711,444 | A | 1/1998 | Meacham et al. |
| 5,725,119 | A | 3/1998 | Bradford et al. |
| 5,788,103 | A | 8/1998 | Wagner et al. |
| 5,797,508 | A | 8/1998 | Loftus et al. |
| 5,845,799 | A | 12/1998 | Deaton |
| 5,850,935 | A | 12/1998 | Luburic et al. |
| 5,897,012 | A | 4/1999 | Sortwell |
| 5,908,135 | A | 6/1999 | Bradford et al. |
| 5,938,059 | A | 8/1999 | Luburic |
| 5,975,324 | A | 11/1999 | Schmitt |
| 6,015,056 | A | 1/2000 | Overholt et al. |
| 6,029,839 | A | 2/2000 | Mansouri |
| 6,029,840 | A | 2/2000 | Brauner |
| 6,062,410 | A | 5/2000 | Bradford et al. |
| 6,088,239 | A | 7/2000 | Zeiss |
| 6,135,287 | A | 10/2000 | Hartwall |
| 6,186,932 | B1 | 2/2001 | Vallot |
| 6,189,695 | B1 | 2/2001 | Ching-rong |
| 6,209,742 | B1 | 4/2001 | Overholt et al. |
| 6,223,903 | B1 | 5/2001 | Mansouri |
| 6,230,916 | B1 | 5/2001 | Bradford et al. |
| 6,243,920 | B1 | 6/2001 | Sauve |
| 6,283,319 | B1 | 9/2001 | Hillis et al. |
| 6,290,081 | B1 | 9/2001 | Merey |
| 6,293,417 | B1 | 9/2001 | Varfeldt |
| 6,293,418 | B1 | 9/2001 | Ogden et al. |
| 6,305,566 | B1 | 10/2001 | Pigott et al. |
| 6,305,726 | B1 | 10/2001 | LeTrudet |
| D452,614 | S | 1/2002 | Overholt |
| 6,386,388 | B1 | 5/2002 | Overholt |
| 6,398,054 | B1 | 6/2002 | Overholt et al. |
| 6,405,888 | B1 | 6/2002 | Overholt et al. |
| 6,416,271 | B1 | 7/2002 | Pigott et al. |
| 6,422,409 | B2 | 7/2002 | Kofod |
| 6,446,825 | B1 | 9/2002 | Godoy |
| 6,460,717 | B1 | 10/2002 | Smyers et al. |
| 6,484,898 | B2 | 11/2002 | Hillis et al. |
| RE37,915 | E | 12/2002 | Lapoint, III |
| 6,540,096 | B1 | 4/2003 | Bazany et al. |
| 6,543,659 | B2 | 4/2003 | Blair |
| 6,601,724 | B1 | 8/2003 | Koefelda et al. |
| 6,631,822 | B1 | 10/2003 | Overholt |
| 6,669,044 | B2 | 12/2003 | Murakami et al. |
| 6,691,885 | B2 | 2/2004 | Brown |
| 6,726,046 | B2 | 4/2004 | Orset |
| 6,776,300 | B2 | 8/2004 | Walsh et al. |
| 6,783,032 | B2 | 8/2004 | Fons |
| 6,783,058 | B2 | 8/2004 | Quaintance |
| 6,786,394 | B2 | 9/2004 | Prince |
| 6,805,254 | B2 | 10/2004 | Tanzer et al. |
| 6,820,761 | B1 | 11/2004 | Mouri et al. |
| 6,838,616 | B2 | 1/2005 | Harrison et al. |
| 6,863,180 | B2 | 3/2005 | Apps et al. |
| 6,868,979 | B2 | 3/2005 | Rader |
| 6,877,628 | B2 | 4/2005 | Nesting |
| 6,899,242 | B2 | 5/2005 | Overholt et al. |
| 6,902,061 | B1 | 6/2005 | Elstone |
| 6,918,502 | B1 | 7/2005 | Overholt et al. |
| 6,955,273 | B2 | 10/2005 | Hartwall |
| 6,966,449 | B2 | 11/2005 | Williams |
| 7,011,225 | B2 | 3/2006 | Oster et al. |
| 7,017,765 | B2 | 3/2006 | Overholt |
| 7,017,766 | B2 | 3/2006 | Hsu et al. |
| 7,032,765 | B2 | 4/2006 | Miller et al. |
| 7,044,319 | B2 | 5/2006 | Overholt et al. |
| 7,048,135 | B2 | 5/2006 | Smyers et al. |
| 7,059,489 | B2 | 6/2006 | Apps et al. |
| 7,063,223 | B2 | 6/2006 | Iwahara et al. |
| 7,083,369 | B2 | 8/2006 | Nyeboer |
| 7,100,786 | B2 | 9/2006 | Smyers |
| 7,104,414 | B2 | 9/2006 | Apps et al. |
| 7,128,209 | B2 | 10/2006 | Bringard et al. |
| 7,128,231 | B2 | 10/2006 | Overholt |
| 7,137,522 | B2 | 11/2006 | Dubois |
| 7,159,730 | B2 | 1/2007 | Rumpel |
| 7,195,127 | B2 | 3/2007 | Hsu et al. |
| 7,258,232 | B2 | 8/2007 | Bradford et al. |
| 7,264,122 | B2 | 9/2007 | Koefelda et al. |
| 7,287,661 | B2 | 10/2007 | Knutsson et al. |
| 7,311,220 | B2 | 12/2007 | Kellerer |
| 7,331,480 | B1 | 2/2008 | Nolan |
| 7,347,328 | B2 | 3/2008 | Hartwall |
| 7,357,269 | B2 | 4/2008 | Apps |
| 7,370,771 | B2 | 5/2008 | Rader |
| 7,416,092 | B2 | 8/2008 | Dubois et al. |
| 7,484,634 | B2 | 2/2009 | Apps |
| 7,540,390 | B2 | 6/2009 | Bublitz et al. |
| 7,774,919 | B2 | 8/2010 | Bublitz et al. |
| 7,828,167 | B2 | 11/2010 | Nolan |
| 7,861,458 | B2 | 1/2011 | Apps et al. |
| 8,267,270 | B2 | 9/2012 | Samprathi |
| 8,413,831 | B2 | 4/2013 | Nolan |
| 2002/0108950 | A1 | 8/2002 | Moorman et al. |
| 2004/0084447 | A1 | 5/2004 | Dubois |
| 2004/0182858 | A1 | 9/2004 | Smyers |

(56) References Cited

U.S. PATENT DOCUMENTS

| | | | | |
|---|---|---|---|---|
| 2004/0200833 | A1 | 10/2004 | Dubois | |
| 2005/0098556 | A1 | 5/2005 | Kellerer | |
| 2006/0011627 | A1 | 1/2006 | Overholt et al. | |
| 2006/0231555 | A1 | 10/2006 | Smyers et al. | |
| 2006/0237456 | A1 | 10/2006 | McDade | |
| 2006/0249416 | A1 | 11/2006 | Bradford | |
| 2007/0029319 | A1 | 2/2007 | Speck | |
| 2007/0056967 | A1 | 3/2007 | Dobrinski et al. | |
| 2007/0056977 | A1 | 3/2007 | Dobrinski et al. | |
| 2007/0068941 | A1 | 3/2007 | Dubois | |
| 2007/0075077 | A1 | 4/2007 | Dubois | |
| 2007/0095692 | A1 | 5/2007 | Apps | |
| 2007/0095842 | A1 | 5/2007 | Apps | |
| 2007/0181587 | A1 | 8/2007 | Burnham | |
| 2007/0194023 | A1 | 8/2007 | Apps et al. | |
| 2007/0272579 | A1 | 11/2007 | Cavalcante | |
| 2007/0278223 | A1 | 12/2007 | Ficker | |
| 2008/0017638 | A1 | 1/2008 | Bradford | |
| 2008/0116199 | A1 | 5/2008 | Bublitz et al. | |
| 2008/0116201 | A1 | 5/2008 | Baltz | |
| 2008/0169285 | A1 | 7/2008 | Marazita et al. | |
| 2008/0179322 | A1 | 7/2008 | Parnall et al. | |
| 2008/0203089 | A1 | 8/2008 | Hartwall | |
| 2009/0044376 | A1 | 2/2009 | Nolan | |
| 2009/0134176 | A1* | 5/2009 | Yamauchi | 220/666 |
| 2009/0152265 | A1 | 6/2009 | Nolan | |
| 2009/0266813 | A1 | 10/2009 | Afflerbach et al. | |
| 2010/0038331 | A1 | 2/2010 | Ydstrom | |
| 2010/0072199 | A1 | 3/2010 | Manuel | |
| 2010/0275426 | A1 | 11/2010 | Bublitz et al. | |
| 2011/0127275 | A1 | 6/2011 | Dubois | |
| 2011/0139775 | A1 | 6/2011 | Nolan | |
| 2011/0220643 | A1 | 9/2011 | Van Der Korput et al. | |
| 2011/0240639 | A1 | 10/2011 | Nolan | |
| 2013/0001225 | A1 | 1/2013 | Samprathi | |

FOREIGN PATENT DOCUMENTS

| | | | |
|---|---|---|---|
| CN | 200930355383.4 | | 7/2010 |
| CN | 200930355384.9 | | 7/2010 |
| CN | 201020111642.6 | | 11/2010 |
| CN | 201020145498.8 | | 12/2010 |
| CN | 201020159206.6 | | 12/2010 |
| CN | 201020198781.7 | | 12/2010 |
| CN | 201020132357.2 | | 1/2011 |
| CN | 201020218082.4 | | 1/2011 |
| CN | 201020218085.8 | | 4/2011 |
| CN | 201020169698.7 | | 5/2011 |
| DE | 135488 | C | 11/1933 |
| EP | 0385914 | A1 | 5/1990 |
| EP | 0485672 | A1 | 5/1992 |
| EP | 0785142 | A1 | 7/1997 |
| EP | 0768229 | B1 | 7/1999 |
| EP | 1019293 | B1 | 5/2002 |
| EP | 0737152 | B1 | 8/2002 |
| EP | 1350728 | A2 | 10/2003 |
| EP | 1418130 | A1 | 5/2004 |
| EP | 1427641 | B1 | 6/2004 |
| EP | 1461259 | B1 | 9/2004 |
| EP | 1440011 | B1 | 6/2006 |
| EP | 1472147 | B1 | 9/2006 |
| EP | 1827942 | A2 | 9/2007 |
| EP | 1927552 | A2 | 6/2008 |
| EP | 1935792 | A1 | 6/2008 |
| EP | 1616803 | B1 | 10/2009 |
| FR | 80400 | E | 10/1961 |
| FR | 2272907 | A1 | 12/1975 |
| GB | 2415689 | A | 1/2006 |
| GB | 2425303 | A | 10/2006 |
| GB | 2431921 | A | 5/2007 |
| GB | 2431922 | A | 5/2007 |
| GB | 2438506 | A | 11/2007 |
| GB | 2443949 | A | 5/2008 |
| GB | 2426237 | B | 12/2008 |
| SE | 323908 | B | 5/1970 |
| SE | 522095 | C2 | 1/2004 |
| WO | 0176960 | A1 | 10/2001 |
| WO | 03024815 | A1 | 3/2003 |
| WO | 03029090 | A1 | 4/2003 |
| WO | 03059763 | A1 | 7/2003 |
| WO | 03074376 | A1 | 9/2003 |
| WO | 03078259 | A1 | 9/2003 |
| WO | 03101846 | A1 | 12/2003 |
| WO | 2004033311 | A2 | 4/2004 |
| WO | 2004080830 | A1 | 9/2004 |
| WO | 2004085779 | A2 | 10/2004 |
| WO | 2004094250 | A1 | 11/2004 |
| WO | 2004101376 | A1 | 11/2004 |
| WO | 2005102852 | A1 | 11/2005 |
| WO | 2006044488 | A2 | 4/2006 |
| WO | 2006062894 | A2 | 6/2006 |
| WO | 2007035464 | A2 | 3/2007 |
| WO | 2007109468 | A2 | 9/2007 |
| WO | 2008033668 | A2 | 3/2008 |

* cited by examiner

BULK CONTAINER WITH ANGLED SIDE WALL TO BASE INSTALLATION

CROSS-REFERENCE TO RELATED APPLICATIONS

The present application is a continuation of U.S. patent application Ser. No. 12/963,751 filed on Dec. 9, 2010, the contents of which are incorporated herein by reference.

The present application claims the benefit of Chinese Patent Application No. 200930355384.9, entitled Nine Feet Geometric Bulk Plastic Container—No Door, filed Dec. 16, 2009, issued Jul. 28, 2010; Chinese Patent Application No. 200930355383.4, entitled Stringer Geometric Bulk Plastic Container, filed Dec. 16, 2009, issued Jul. 28, 2010; Chinese Patent Application No. 200930355382.X, entitled Nine Feet Geometric Bulk Plastic Container, filed Dec. 16, 2009, issued Jul. 28, 2010; Chinese Patent Application No. 201020111642.6, entitled Bulk Plastic Container Panel By Geometric Structure, filed Feb. 10, 2010, issued Nov. 3, 2010; Chinese Patent Application No. 201020132357.2, entitled Universal Latch for Bulk Plastic Container, filed Mar. 16, 2010, issued Jan. 19, 2011; Chinese Patent Application No. 201020145498.8, entitled Floating Hinge Lock Structure, filed Mar. 30, 2010, issued Dec. 1, 2010; Chinese Patent Application No. 201020159206.6, entitled Erected Side Wall Lock Structure, filed Apr. 14, 2010, issued Dec. 29, 2010; Chinese Patent Application No. 201020169698.7, entitled 45 Degree Assembly Structure for Side Wall, filed Apr. 23, 2010, issued May 4, 2011; Chinese Patent Application No. 201020198781.7, entitled Notch Structure for Low Profile Container, filed May 19, 2010, issued Dec. 29, 2010; Chinese Patent Application No. 201020218085.8, entitled Lock Structure for Connecting Panel—Long Ribs and Short Ribs, filed Jun. 4, 2010, issued Apr. 13, 2011; Chinese Patent Application No. 201020218082.4, entitled Double Rib Structure on Panels, filed Jun. 4, 2010, issued Jan. 19, 2011, the contents of all of which are incorporated herein by reference.

The present application also claims the benefit of U.S. patent application Ser. No. 12/963,791 filed on Dec. 9, 2010, entitled "Collapsible Bin," now U.S. Pat. No. 8,413,831 issued on Apr. 9, 2013; and U.S. patent application Ser. No. 12/963,769 filed Dec. 9, 2010, entitled "Fork Tine Notch," the contents of which are incorporated herein by reference.

FEDERALLY SPONSORED RESEARCH OR DEVELOPMENT

N/A

FIELD OF THE INVENTION

The present invention generally relates to a bulk bin container having a base and a plurality of side walls that must be positioned at a particular angle to install in the base; and more particularly, to a bulk bin having a base and a plurality of side walls having integrally formed hinge lugs with an angled flat portion (e.g., 45° with respect to horizontal) that cooperates with an opening in a hinge slot in the base to require installation of the side wall at a first angle.

DESCRIPTION OF THE PRIOR ART

Bulk bin containers are typically formed from molded plastic and include a base and four side walls extending upward from the base. To decrease the volume of the containers for efficient shipment when empty, the side walls are hingedly connected to the base so that they can be collapsed inward.

Many bulk bin containers include four separate hinge rods (one for each side wall) typically made of fiberglass to provide the hinged connection. This requires additional parts and labor (i.e., a secondary installation operation during the molding process) in the manufacture of the containers and increases the costs of such containers.

When utilizing a hinge rod, the bulk bin container can be formed to allow the hinge (and attached side wall) to float, that is, move up or down in a slot. Each side wall can be provided with a different amount of float by adjusting the length of the slot, or alternatively, each side wall can be given the same maximum float length. In each alternative, the side walls can be can be stacked horizontally, one on top of the other. However, in instances where each slot length is different, the side walls typically must be collapsed in a particular order. In the alternative, the side walls can be collapsed in any order.

Other bulk bin containers are formed with integrally formed hinge elements. Such elements can include cylindrical projections in one component of the container (base or side wall) that cooperate with corresponding cylindrical holes in the other component. In this configuration it is more difficult to provide any float length in the hinge.

The present invention provides an improved bulk bin having a four foldable side walls with a unique integrally form hinge element.

SUMMARY OF THE INVENTION

The present invention provides a bulk bin container that includes a base portion and a plurality of side walls hingedly connected to the base portion. The base portion and side walls of the bulk bin container can be formed from plastic in a molding operation. Alternatively, other conventional materials or processes can be used to form the base portion and side walls.

The base portion and side walls of the bulk bin container are designed such that no hinge rods are needed (and thus no secondary installation operations are required) to hingedly connect the side wall to the base portion. Instead, the hinge rod is replaced with a plurality of integrally molded lugs in the side walls. The molded lugs are formed on the ends of one or more hinge knuckles that extend from a lower portion of each side wall. For example, depending on the size of the bin and side wall, the side wall can include four hinge knuckles extending downward from a bottom of the side wall, in which each knuckle has a first lug extending outward from a first side of the knuckle, and a second lug extending outward from a second side of the knuckle.

The lugs are designed to fit into and cooperate with hinge slots formed in the base portion. In some instances, the slots can be a sufficient length to provide a floating hinge connection between the side wall and base portion. In this regard, the hinge lug is able to move up and down in the slot. This can be used to allow the side wall to lay flat in a collapsed position regardless of the order in which each side wall is collapsed.

At least one of the lugs on a side wall is provided with an angled flat portion that decreases the overall diameter of the lug. Preferably, the flat portion is on a 45° angle (with respect to the horizontal when the side wall is in an upright position), however, other angles can be utilized. In this configuration, the angled flat portion starts on the bottom of the lug (when the side wall is positioned upright). However, the angled flat portion can be positioned at other locations on the lug. Moreover, other angles can be used (and when positioned on the top of the lug, the angle would be negative).

The base includes at least one lug slot or pocket that includes an entrance sized to accept the at least one lug having an angled flat portion. That is, the at least one lug slot includes a corresponding entrance having a flat portion matching the flat portion on the lug that leads to a hinge pivot slot in which the lug can float.

Other lugs in the side wall can include an angled flat portion, or have a conventional cylindrical shape. The base will include corresponding lug slots or pockets for each of the lugs in the side walls. Preferably, the two outermost lugs on opposing sides of the side wall have an angled flat portion.

The side wall is installed in the base by holding the side wall at the angle of the flat portion of the at least one lug (such that the flat portion is substantially horizontal or otherwise in alignment with the corresponding flat portion in the opening of the lug slot, and the side wall extends at the angle of the flat portion with respect to a horizontal plane), and bringing it into engagement with the lug slots. For example, if the angle of the flat portion is 45°, the side wall is held at this angle, and the hinge knuckles are move toward the base slots or pockets. The lugs on the hinge knuckles are aligned with the openings of the respective slots in the base, and are moved toward the openings until the lugs are engaged in the slots. At this point, the side wall can float up and down in the slots in the base. Moreover, the side wall can rotate about the lugs to lay flat (in a collapsed position), or to stand up perpendicular to a support surface of the base (in an erect position). The only way the side wall can be removed is to raise the side wall so that the lugs are proximate the openings in the slots, and rotate the side wall to a 45° angle. Due to the size of the slot in the base and the size of the lug on the side wall, the side wall cannot be removed unless it is aligned to the position in which it was installed. The installation position is placed in such a manner that is not normal to normal operation of the bulk bin container.

In accordance with one aspect of the invention, a bulk bin container configured to have side walls installable at an angle is provided. The bulk bin container comprises a generally rectangular base portion having a first end, an opposing second end, a first side and an opposing second side. The first end of the base portion includes a first hinge slot configured to cooperate with a hinge lug of a side wall. The first hinge slot including an opening proximate a top portion of the hinge slot. The container also includes a first side wall having a bottom portion, and a first hinge lug connected to the bottom portion. The first hinge lug is formed having a first generally cylindrical portion and a second angled flat portion. The first hinge lug is configured to be received in the opening of the first hinge slot to hingedly connect the first side wall to the base.

The first hinge slot can further include a flat horizontal portion proximate the opening of the hinge slot. When the side wall is installed, the angled flat portion of the first hinge lug of the side wall is set at a first angle with respect to horizontal when the first side wall is in an upright position. This first angle is preferably approximately 45°; however, other angles can be used. During installation the opening is configured such that the flat angled portion of the lug must be positioned horizontally to allow the lug to be inserted. This forces the side wall to be positioned at the first angle.

The first end of the base portion is configured to have a plurality of hinge slots to match with a plurality of hinge lugs in the side wall. Moreover, the other end and each side of the base portion are similarly configured.

The first side wall includes a first knuckle portion extending from the bottom portion of the first side wall. The first lug extends outward from a first side of the first knuckle. Additional knuckles and lugs can be provided on the bottom portion of the first side wall.

Preferably, the first lug is positioned proximate a first side of the side wall, and a second lug—also having a first generally cylindrical portion and a second flat angled portion—is positioned approximate a second side of the first side wall. Additional lugs can be generally cylindrical and not include a flat angled portion or segment. A larger opening can be utilized with hinge slots associated with such lugs.

The first hinge slot has a length greater than a diameter of the first lug. This allows the first hinge lug to move upward or downward (or "float") within the first hinge slot. When each side or end of the base portion has similar hinge slots, the side walls can be collapsed flat in any order.

In accordance with another embodiment of the invention, a collapsible bulk bin container with installable side walls is provided. The container comprises a generally rectangular base portion having a first side, an opposing second side, a first end, and an opposing second end. A first side wall is hingedly connected to the first side of the base portion, a second side wall is hingedly connected to the second side of the base portion, a third side wall is hingedly connected to the first end of the base portion and a fourth side wall is hingedly connected to the second end of the base portion. The first side of the base portion includes a first hinge slot having a slot opening and the first side wall includes a first hinge lug having a first generally cylindrical portion and a second angled flat portion configured to be received by the first hinge slot when the first side wall is positioned at a first angle.

The second side of the base portion also includes a second hinge slot having a slot opening and the second side wall includes a first hinge lug having a first generally cylindrical portion and a second angled flat portion configured to be received by the second hinge slot when the second side wall is positioned at a second angle. Preferably, the second angle is equal to the first angle.

Further aspects of the invention are disclosed in the description of the invention including the Figures.

BRIEF DESCRIPTION OF THE DRAWINGS

To understand the present invention, it will now be described by way of example, with reference to the accompanying drawings in which.

DETAILED DESCRIPTION

Figure 1:
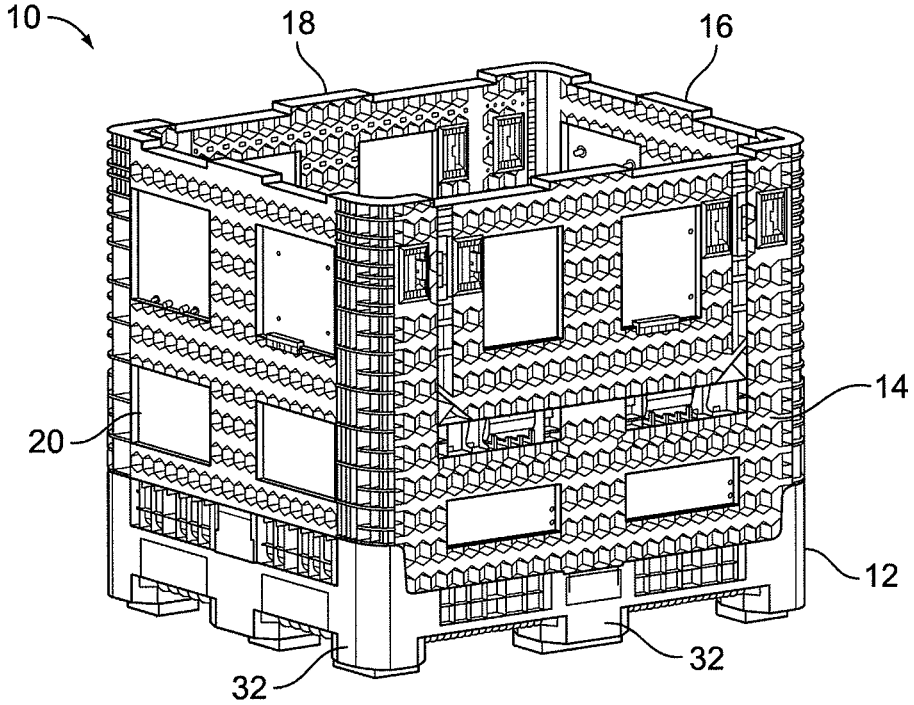
FIG. 1 is a perspective view of a bulk bin container for use with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides integrally formed hinge elements for use in a collapsible bulk bin container. The use of such integrally formed hinge elements means that a separate hinge pin is not required and does not have to be installed. This lowers the cost of manufacturing the containers and eliminates a part that is prone to damage.

The structure of the hinge elements—both on the side walls and the base portion—requires the installation of the side walls at specific angles. This lessons the likelihood of a side wall becoming unexpectedly unhinged during use.

Figure 2:
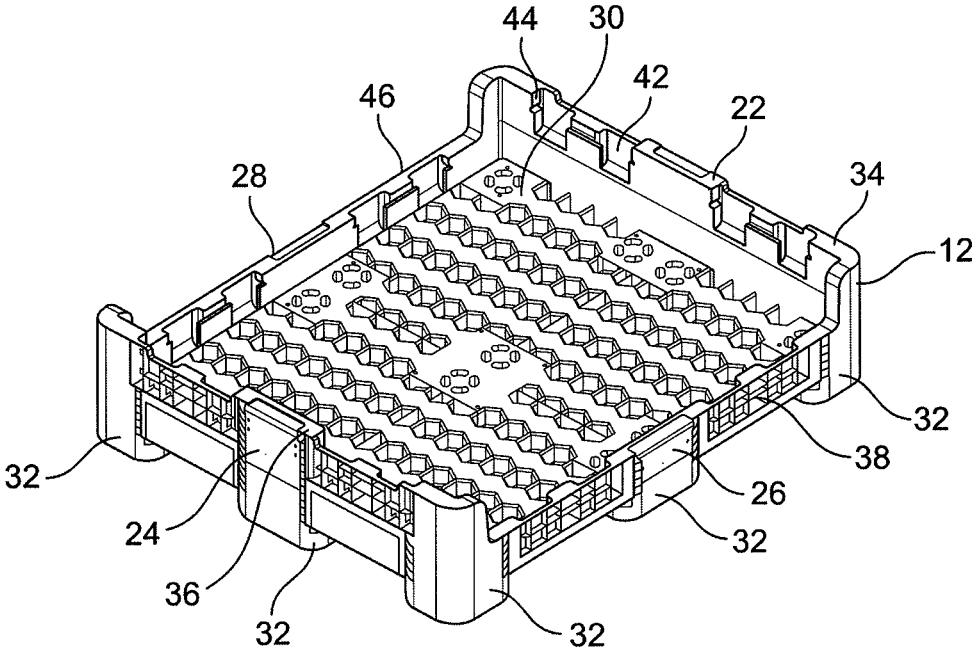
FIG. 2 is a perspective view of a base portion of the bulk bin container of FIG. 1.

Referring to FIGS. 1 and 2, the bulk bin container 10 includes a generally rectangular or square base portion 12 with four, collapsible side walls 14, 16, 18, 20 extending upward (when in a fully erect configuration) from each of two opposing sides 22, 24 and two opposing ends 26, 28 of the base portion 12. The base portion 12 includes a generally flat central bottom wall having an upper support surface 30 for supporting goods or other items in the container 10. Additionally, the base portion 12 includes a plurality of support legs 32 extending downward. The support legs are positioned to allow tines from a fork lift, hand cart or other similar apparatus to be placed under the container 10 in order to lift it.

The base portion 12 also includes short wall panels 34, 36 extending upward from the sides 22, 24, and even shorter wall panels 38, 40 extending upward from each end 26, 28 of the base portion 12. The wall panels 34, 36, 38, 40, include pockets for receiving hinge elements on the respective side walls.

Figure 3:
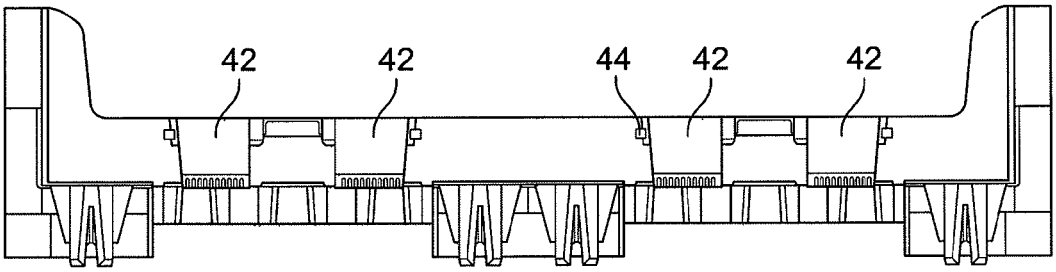
FIG. 3 is a cross-sectional view showing a side of the base portion and a plurality of hinge slots.
Figure 4:
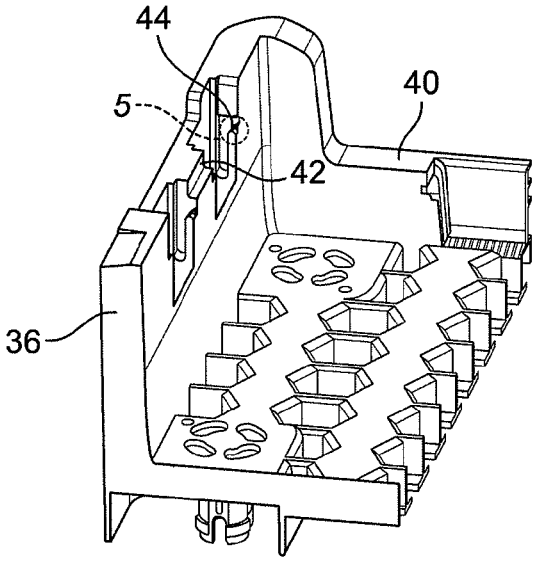
FIG. 4 is a perspective view showing an enlargement of the hinge slot on an end of the base portion.
Figure 5:
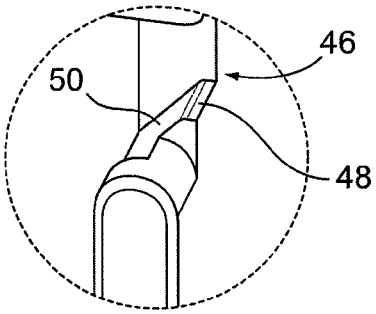
FIG. 5 is an enlarged perspective view of an opening to the hinge slot shown in FIG. 4.

As illustrated in FIGS. 3 and 4, each wall panel 34, 36, 38, 30 of the base portion 12 includes a number of pockets 42 and hinge slots 44 for receiving hinge knuckles and associated hinge lugs on the side walls (the side walls are described in more detail below). The pockets 42 are sized and configured to correspond in shape to the knuckles on the side walls.

Each hinge slot 44 includes an opening 46 at the top of the slot 44. The opening 46 includes a lower horizontal segment 48 at the mouth of the opening 46. The lower horizontal segment 48 is connected to an angled segment 50 that slants downward into the slot 44. The slot 44 is a sufficient length to allow a hinge lug on a side wall to move up and down within the slot.

Figure 6:
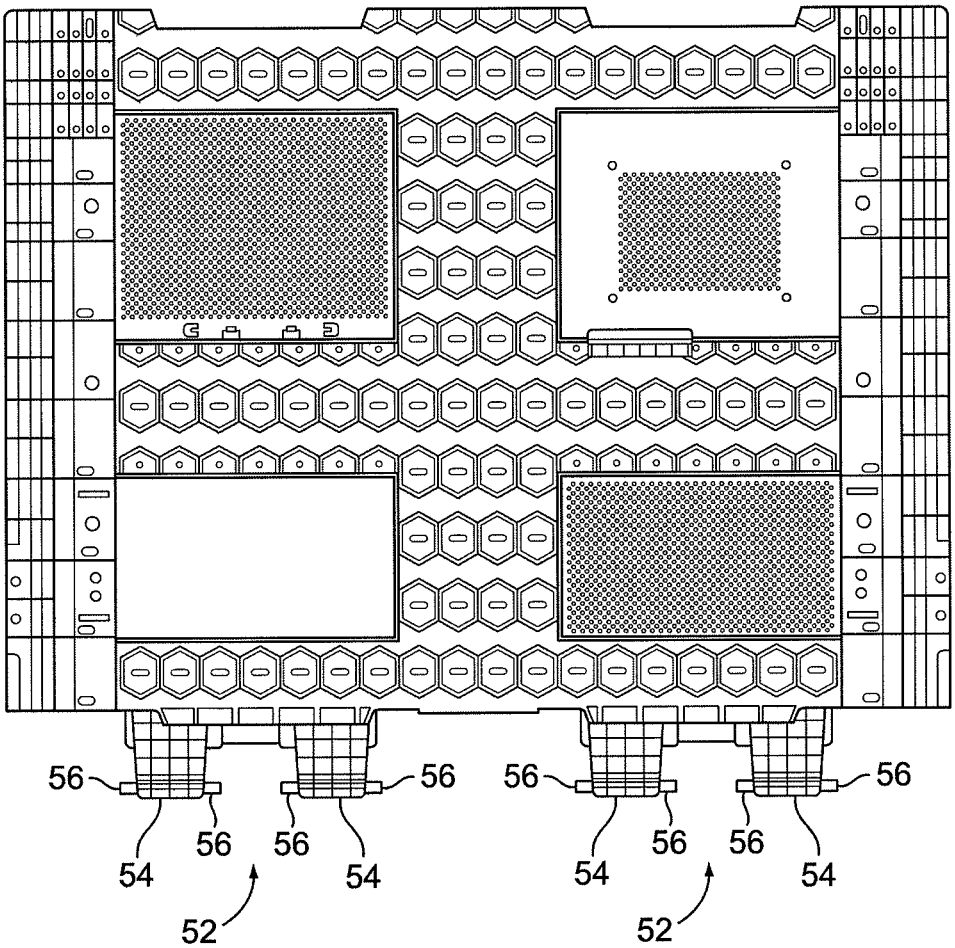
FIG. 6 is a plan view of a first type of side wall that can be hingedly connected to the base portion.
Figure 7:
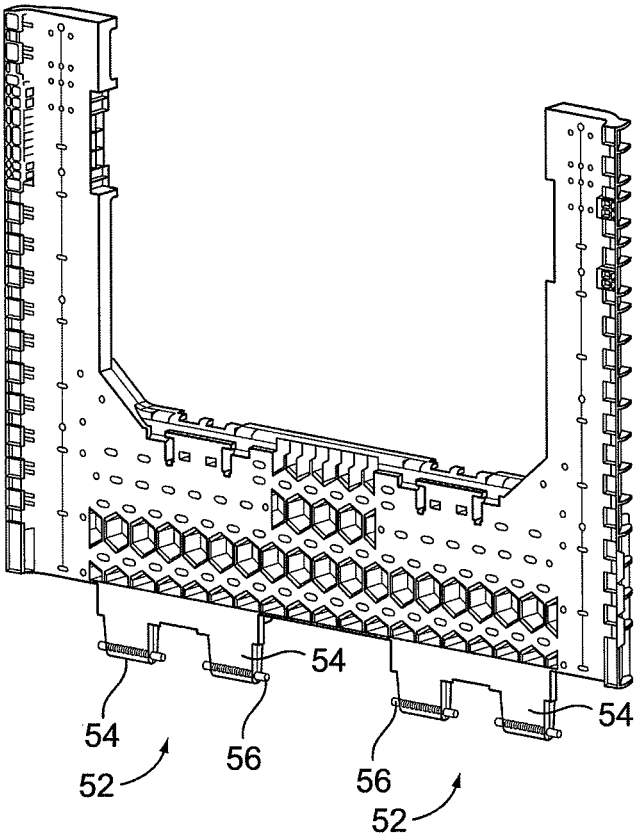
FIG. 7 is a perspective view of a second type of side wall that can be hingedly connected to the base portion.

FIG. 6 discloses a first side wall embodiment for use with the bin container 10. FIG. 7 discloses a second embodiment of a side wall for use with the bin container 10. The second embodiment includes a door hingedly connected to the side wall (and forming part of the side wall when closed). Such doors allow access to the interior of the bin container when the container includes a top, or multiple containers are stacked upon each other.

In either case, each side wall includes two sets of hinge knuckles 52 that extend downward from the bottom edge of the side wall. Each set includes two hinge knuckles 54 for a total of four hinge knuckles 54 (however, the number of knuckles can be fewer or greater than four depending on the requirements and dimensions of the bin container).

Figure 8:
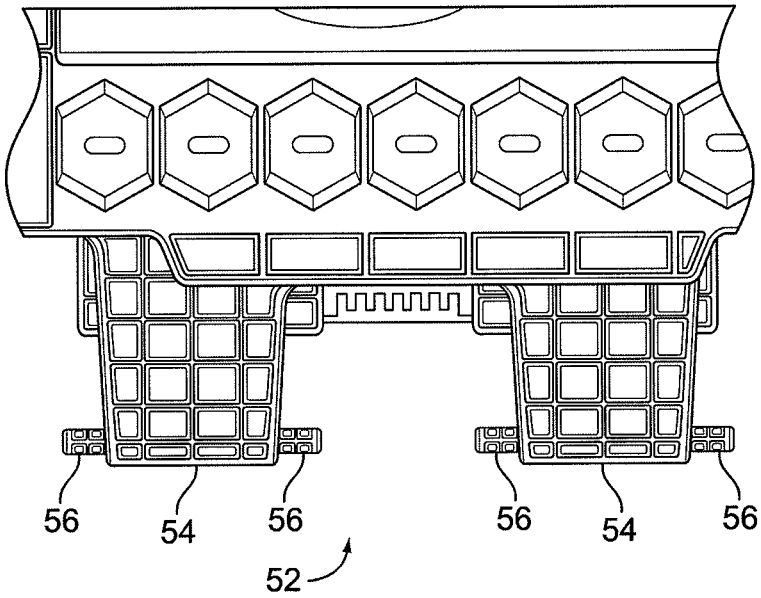
FIG. 8 is a front plan view of a bottom portion of a side wall showing first and second hinge knuckles.

Also referring to the enlargement of FIG. 8, each hinge knuckle 54 includes a first hinge lug 56 extending from a first side of the knuckle 54, and a second hinge lug 56 extending from a second side of the hinge knuckle 54. As explained below, the first and second hinge lugs are not necessarily identical.

Figure 9:
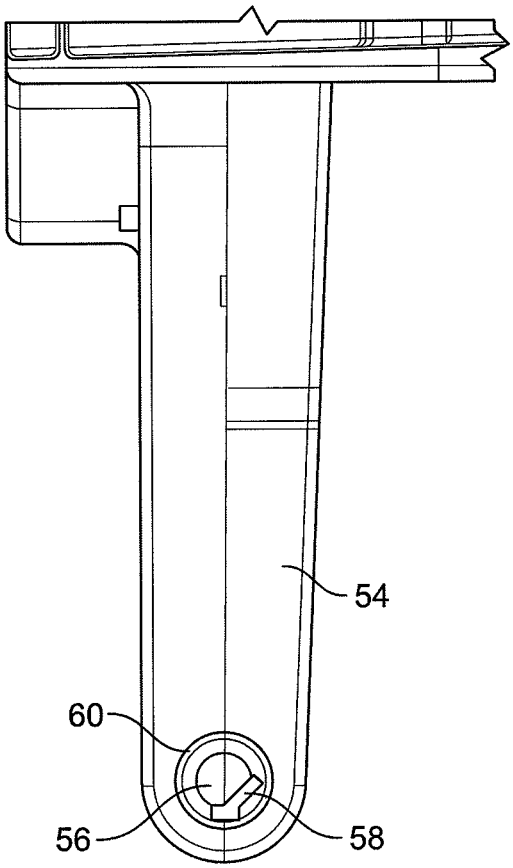
FIG. 9 is a side view of a hinge knuckle of a side wall showing a hinge lug with a flat angled portion in accordance with the present invention.

In accordance with aspects of the present invention, at least one or more of the hinge lugs 56 on a side wall include a flat angled segment. Referring to the side view of FIG. 9, the hinge lug 56 shown includes a first flat angled segment 58, and a second generally cylindrical segment 60 which spans the remainder of the lug. As shown, the flat angled segment 58 is at a 45° with respect to a horizontal line when the side wall is in an upright position, however, other angles may work.

Figure 10:
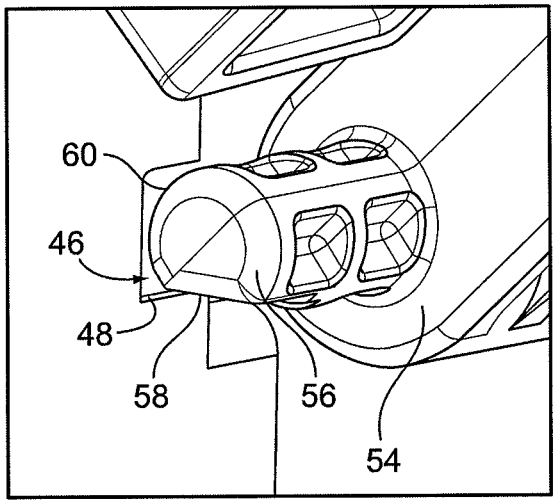
FIG. 10 is an enlarged perspective view of a hinge lug with an angled flat portion positioned in an opening of a hinge slot in a base portion.
Figure 11:
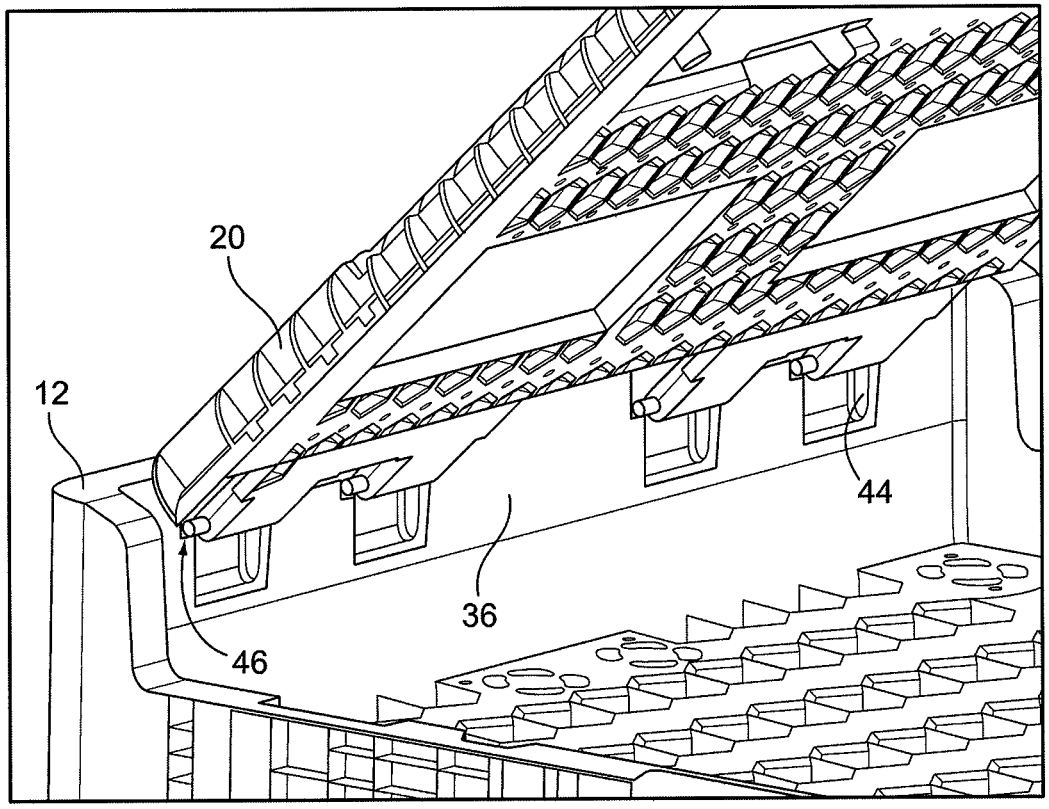
FIG. 11 is a perspective view of a side wall being installed to a base portion.

Referring to FIG. 10, the opening 46 of the hinge slot 44 is sized to require the flat angled segment 58 to initially line up with the horizontal opening segment 48 in order to fit in the opening 46. This forces the side wall to be positioned at a 45° with respect to the base portion 12 (or more particularly, the upper support surface 30 of the bottom of the base portion 12) as shown in FIG. 11.

FIGS. 12A-12I provide a cross-sectional view of the hinge lug 56 moving into the hinge slot 44. That is, these Figures show, in progression, installation of a side wall with a hinge lug 56 having a flat angled segment 58 into a hinge slot 44 on a base portion 12.

Figure 12A:
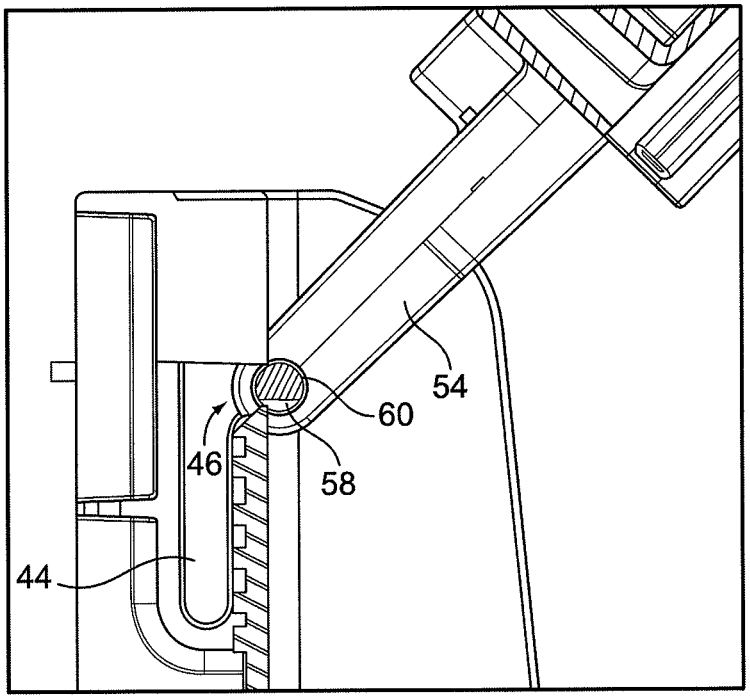
FIGS. 12 A-I are side views showing in progression installation of a hinge lug with a flat angle portion of a side wall to the base; and, FIG. 13 is an enlarged view of a hinge lug (without a flat angled portion) of the side wall positioned at the top of a hinge slot in the base portion.
Figure 12B:
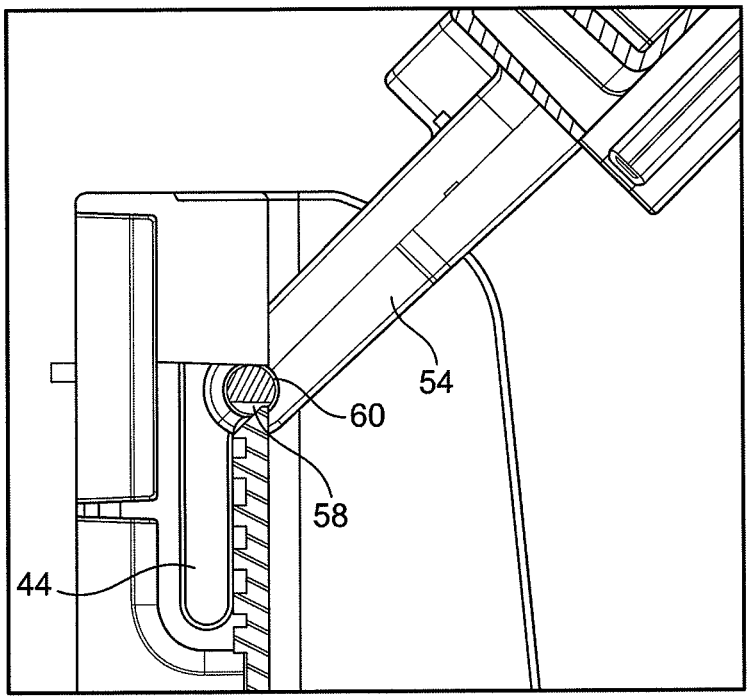
Figure 12C:
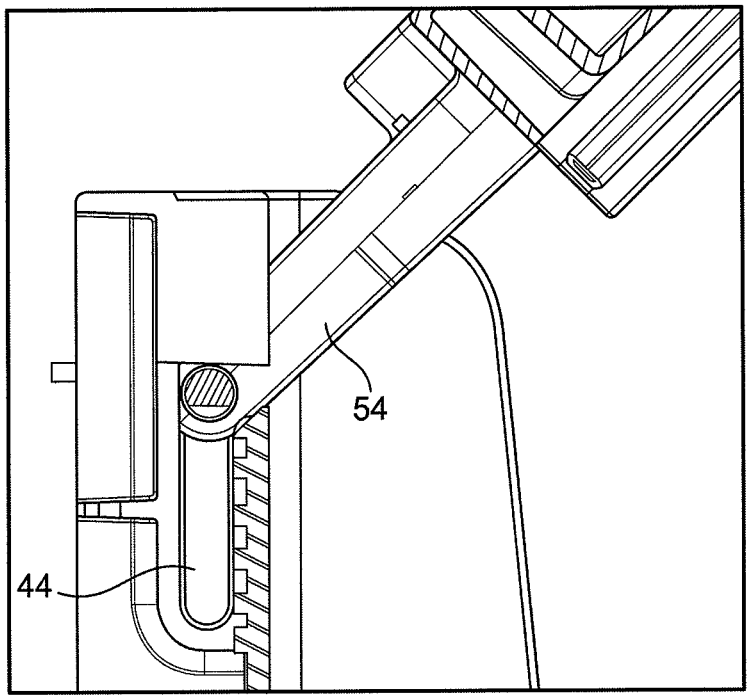
Figure 12D:
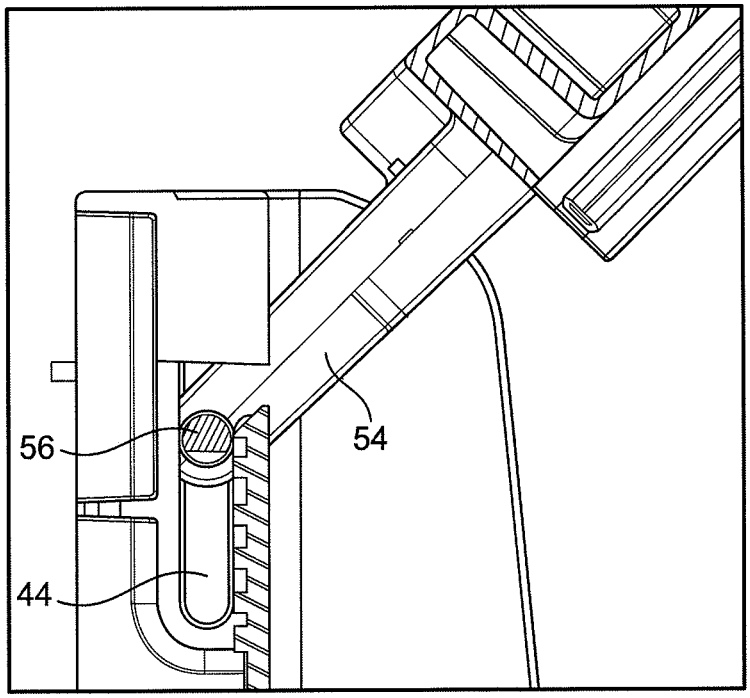
Figure 12E:
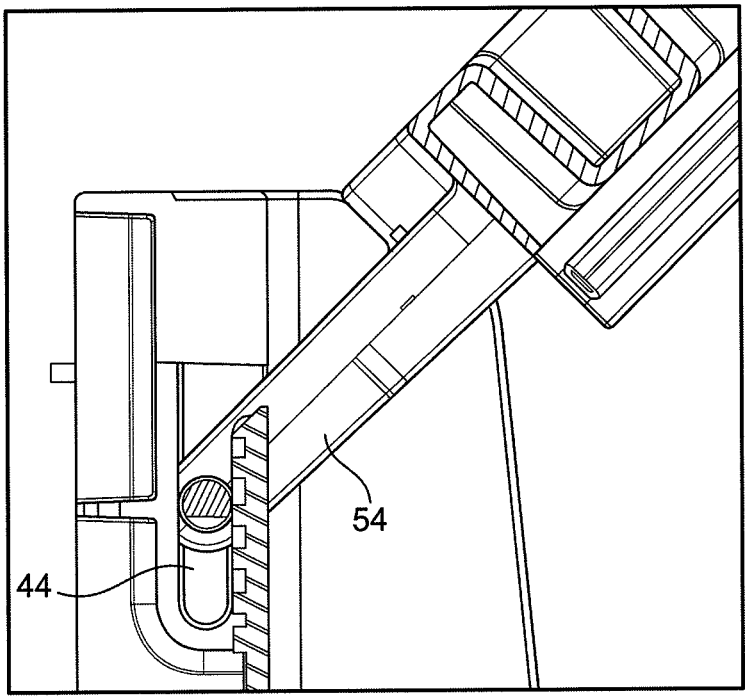
Figure 12F:
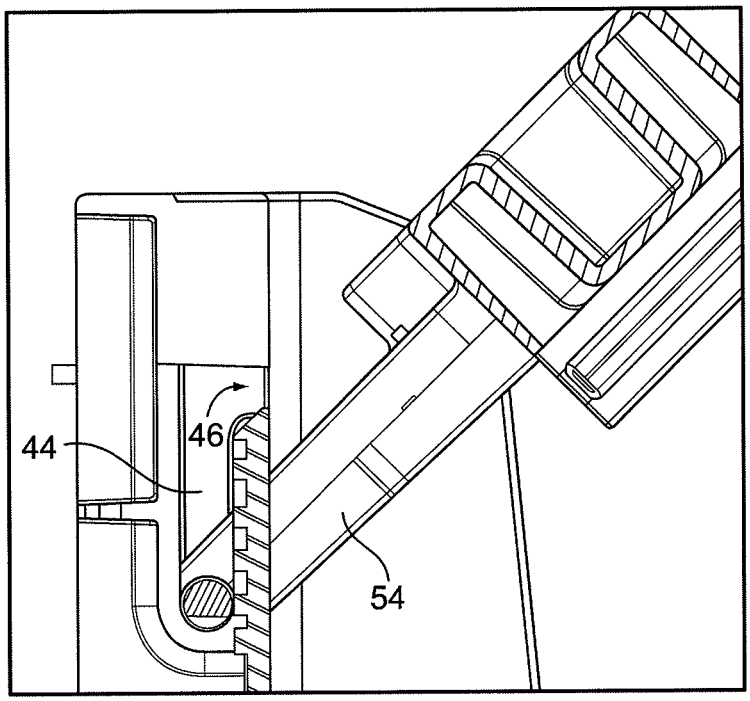
Figure 12G:
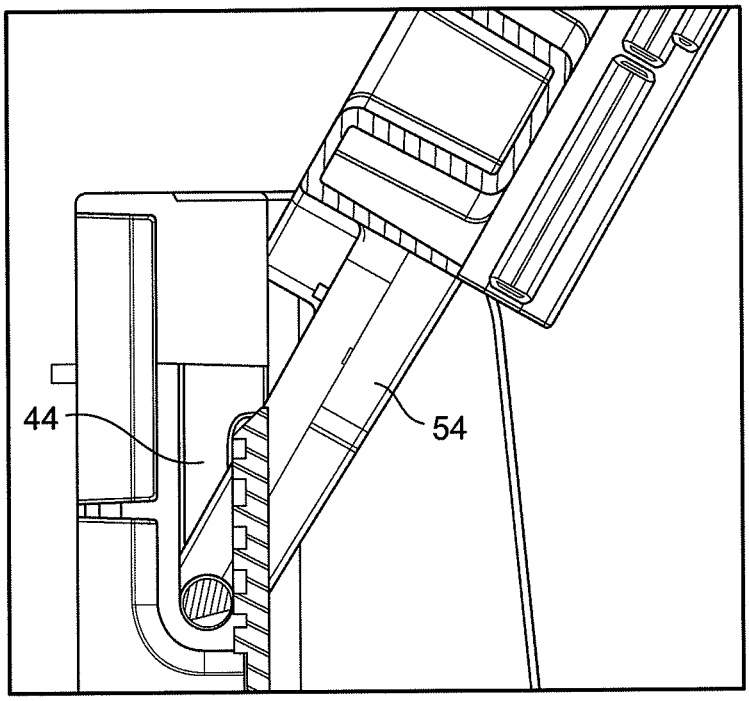
Figure 12H:
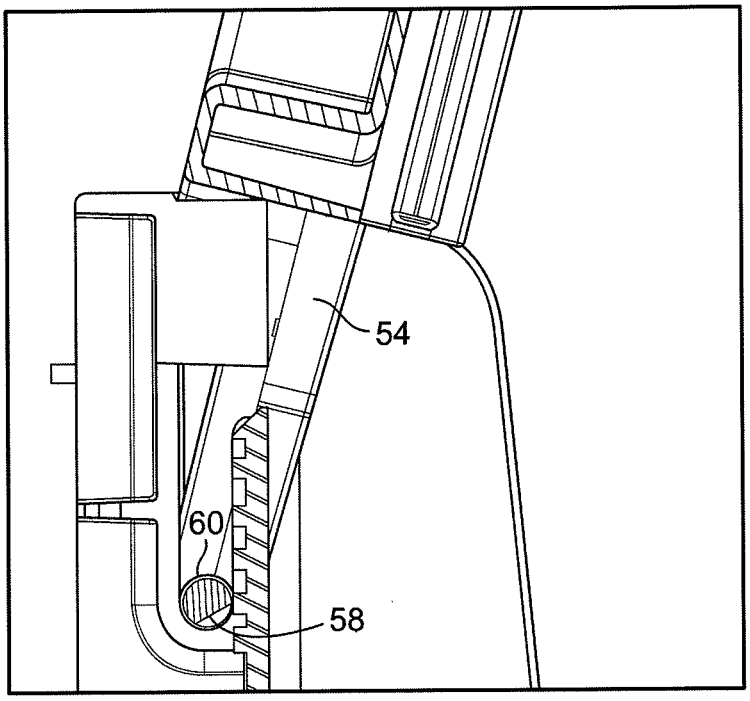
Figure 12I:
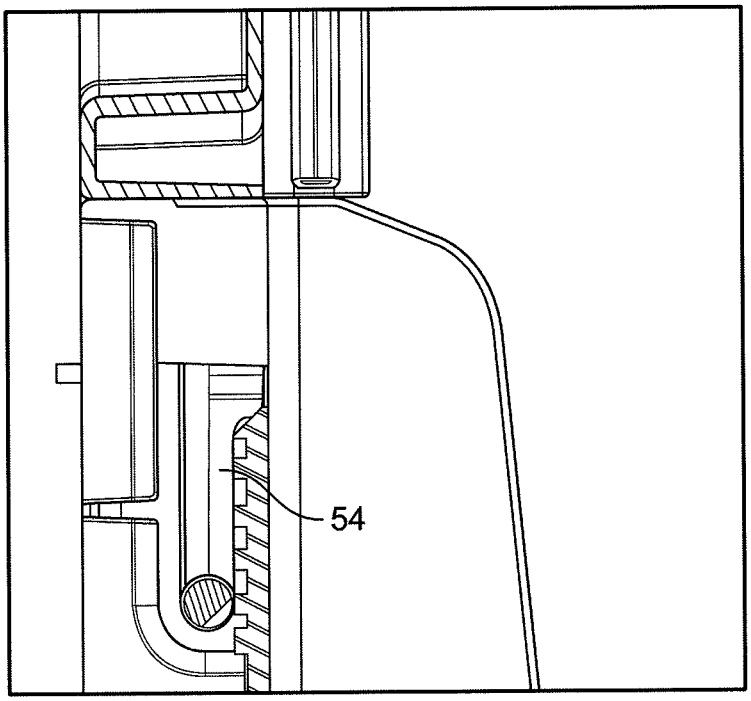

Referring to FIG. 12A, it is necessary for the flat angled segment 58 of the hinge lug 56 to be positioned so that it is horizontal or parallel to the support surface 30 of the base portion 12 in order to properly fit in the opening 46 of the hinge slot 44. As discussed above, moving the side wall to position the flat angled segment horizontally forces the side wall to assume a 45° with respect to the upper support surface 30 of the bottom of the base portion 12. Keeping the side wall in this position, the hinge lug 56 can be moved back into the hinge slot 44 as shown in FIGS. 12B and 12C.

As shown in FIGS. 12A-12I, the slot 44 is sufficiently long enough to allow the hinge lug 56 (and thus the side wall) to move a significant distance up and down the slot (sometimes referred to in the industry as "floating," e.g., "a floating hinge"). FIGS. 12D-12I show the hinge lug 56 moving downward toward the bottom of the slot 44 as the side wall is rotated into an upright position.

Figure 13:
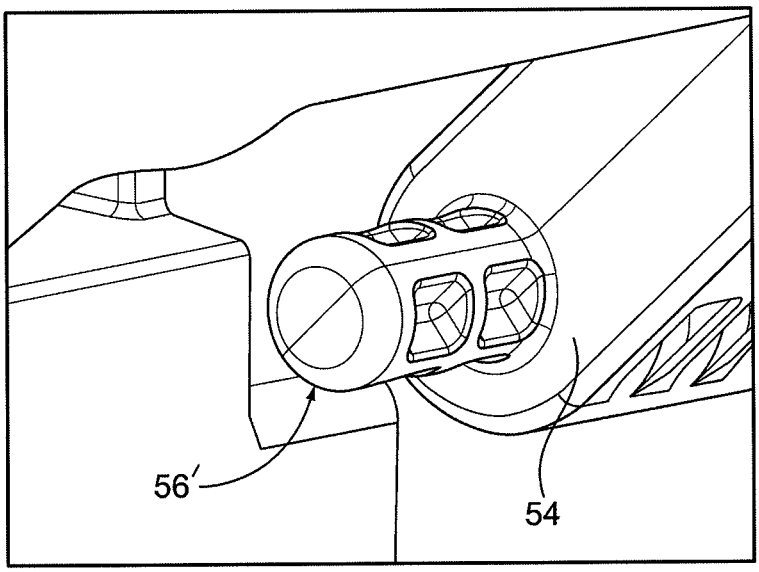

While each hinge knuckle 54 includes an integrally formed hinge lug 56 on each side of the knuckle 54, both hinge lugs 56 do not have to include a flat angled segment 58. Instead, one of the hinge lugs 56 can be made with the flat angled segment 58 and the other hinge lug can be generally cylindrical around its entire periphery. Such a hinge lug 56' is shown in FIG. 13. FIG. 13 also shows an opening to the hinge slot that does not limit the size or the positioning of the hinge lug 56' entering the slot (thus, both the fully cylindrical lug 56', or a lug with a flat angled segment could be accommodated by such hinge slots).

Preferably, the two extreme hinge lugs 56—the ones closest to each side of the side wall, include a flat angled segment 58, and the remaining hinge lugs 56 (between the two extreme hinge lugs 56) do not. In this instance, interior hinge knuckles 54 can include generally cylindrical hinge lugs 56 (without flat angled segments 58) on both sides of the hinge knuckle 54.

Many modifications and variations of the present invention are possible in light of the above teachings. It is, therefore, to be understood within the scope of the appended claims the invention may be protected otherwise than as specifically described.

I claim:

1. A bulk bin container comprising:

a generally rectangular base portion having an upper generally planar support surface, a first end, an opposing second end, a first side and an opposing second side, the first end of the base portion including a first hinge slot configured to cooperate with a hinge lug of a side wall, the first hinge slot formed from a first wall extending perpendicular to the upper support surface of the base portion and a second wall extending perpendicular to the upper support surface of the base portion and spaced from the first wall, the first hinge slot including an opening proximate a top of the first wall of the first hinge slot sized to receive the hinge lug when the hinge lug is in a first position, the opening positioned on a side of the hinge slot facing an interior portion of the bulk bin container to provide passage of the hinge lug by movement of the hinge lug parallel to the upper support surface of the base portion, the opening defined by a lower edge and an upper edge extending directly above the opening and being generally parallel to the upper support surface of the base portion and generally aligned with the first wall of the first hinge slot;

a first side wall having a bottom portion; and, a first hinge lug connected to the bottom portion of the first side wall, the first hinge lug having a profile configured to enter the opening of the first hinge slot when in the first position and wherein placement of the first hinge lug in the first position requires positioning the first sidewall at a first non-horizontal and non-vertical angle with respect to the base portion.

2. The bulk bin of claim 1 wherein the first hinge lug comprises a first generally cylindrical portion and a second angled flat portion, and the opening in the first slot comprises a horizontal segment.

3. The bulk bin of claim 1 wherein the first angle is approximately 45°.

4. The bulk bin of claim 1 further comprising:

a second hinge slot included in the first end of the base portion configured to receive a second hinge lug of a side wall.

5. The bulk bin of claim 1 wherein the first side wall includes a first knuckle portion extending from the bottom portion of the first side wall, the first lug extending outward from a first side of the first knuckle.

6. The bulk bin of claim 5 further comprising a second hinge lug extending outward from a second side of the first knuckle portion.

7. The bulk bin of claim 6 further comprising a second knuckle portion extending from the bottom portion of the first side wall.

8. The bulk bin of claim 6 wherein the second hinge lug includes a first generally cylindrical portion and a second angled flat portion.

9. The bulk bin of claim 7 further comprising a third hinge lug extending outward from a first side of the second knuckle portion, and a fourth hinge lug extending outward from a second side of the second knuckle portion.

10. The bulk bin of claim 9 wherein the fourth hinge lug includes a first generally cylindrical portion and a second flat angled portion.

11. The bulk bin of claim 1 wherein the first hinge slot has a length greater than a diameter of the first hinge lug such that the first hinge lug can move one of upward and downward within the first hinge slot.

12. A collapsible bulk bin container comprising:

a generally rectangular base portion having an upper support surface, a first side, an opposing second side, a first end, and an opposing second end;

a first side wall hingedly connected to the first side of the base portion;

a second side wall hingedly connected to the second side of the base portion;

a third side wall hingedly connected to the first end of the base portion; and, a fourth side wall hingedly connected to the second end of the base portion, wherein the first side of the base portion includes a first hinge slot extending perpendicular to the upper support surface and having a slot opening configured to receive a hinge lug when the hinge lug is oriented in a first position and the first side wall includes a first hinge lug wherein the first hinge lug is configured so that the first side wall is at an angle in order to orient the first hinge lug to enable it to pass the slot opening, the slot opening positioned on the hinge slot to provide passage of the hinge lug by movement of the hinge lug parallel to the upper support surface of the base portion, the slot opening defined by a lower edge in the base and an upper edge in the base extending directly above the opening and being generally parallel to the upper support surface of the base portion and aligned with the lower edge.

13. The collapsible container of claim 12 wherein the slot opening includes a flat horizontal segment, and the first hinge lug has a first generally cylindrical portion and a second angled flat portion configured to be received by the first hinge slot when the angled flat portion is aligned with the flat horizontal segment of the hinge slot opening and the first side wall is positioned at a first angle with respect to the flat horizontal segment.

14. The collapsible container of claim 13 wherein the first side wall includes a first knuckle portion extending downward from a bottom portion of the first side wall, and the first lug is integrally connected to and extending outward from a first side of the first knuckle portion.

15. The collapsible container of claim 14 wherein the first knuckle portion includes a second lug having a generally cylindrical shape extending outward from a second side of the first knuckle portion.

16. The collapsible container of claim 15 wherein the first side wall includes a second knuckle portion extending downward from the bottom portion of the first side wall, the second knuckle portion including a third lug extending outward from a first side of the knuckle portion, and a fourth lug extending outward from a second side of the knuckle portion, the fourth lug having a first generally cylindrical portion and a second angled flat portion.

17. The collapsible container of claim 13 wherein the second side of the base portion includes a second hinge slot having a slot opening and the second side wall includes a first hinge lug having a first generally cylindrical portion and a second angled flat portion configured to be received by the second hinge slot when the second side wall is positioned at a second angle.

18. The collapsible container of claim 17 wherein the second angle is equal to the first angle.

19. The collapsible container of claim 12 wherein the base portion includes a plurality of hinge slots about the first and second sides, and first and second ends for receiving hinge lugs on each of the side walls.

20. The collapsible container of claim 12 wherein the first hinge slot allows for one of upward and downward movement of the first hinge lug to enable the side wall to float with respect to the base portion.

* * * * *